US007117994B2

(12) United States Patent
Gratz

(10) Patent No.: US 7,117,994 B2
(45) **Date of Patent: *Oct. 10, 2006**

(54) TWO-SIDED ROLL SUPPORT WITH MULTIPLE RIBS

(75) Inventor: Jeffrey J. Gratz, Hartland, WI (US)

(73) Assignee: Fibreform Containers, Inc., Germantown, WI (US)

( * ) Notice: Subject to any disclaimer, the term of this patent is extended or adjusted under 35 U.S.C. 154(b) by 221 days.

This patent is subject to a terminal disclaimer.

(21) Appl. No.: 10/085,343

(22) Filed: Feb. 28, 2002

(65) Prior Publication Data

US 2002/0151198 A1 Oct. 17, 2002

Related U.S. Application Data

(63) Continuation-in-part of application No. 09/836,769, filed on Apr. 17, 2001, now Pat. No. 7,044,358.

(51) Int. Cl.
*B65D 85/20* (2006.01)
*B65D 5/00* (2006.01)

(52) U.S. Cl. ..... 206/446; 229/100; 206/394; 206/585; 206/593

(58) Field of Classification Search ..... 229/100; 206/391, 394, 443, 593, 389, 523, 585, 587, 206/160

See application file for complete search history.

(56) References Cited

U.S. PATENT DOCUMENTS

| | | | | |
|---|---|---|---|---|
| 2,783,879 | A * | 3/1957 | Emery | 206/443 |
| 2,808,189 | A * | 10/1957 | Williams | 206/592 |
| 3,135,445 | A * | 6/1964 | Reifers | 206/160 |
| 4,195,732 | A | 4/1980 | Bell | |
| 4,832,196 | A | 5/1989 | Butler | |
| D381,180 | S | 7/1997 | Schueneman et al. | |
| D385,080 | S | 10/1997 | Schueneman et al. | |
| D400,441 | S | 11/1998 | Warren | |
| D403,961 | S | 1/1999 | Warren | |
| D408,737 | S | 4/1999 | Warren, Jr. | |
| 5,899,331 | A | 5/1999 | Warren, Jr. | |
| 5,934,467 | A | 8/1999 | Gilfert et al. | |
| 6,142,440 | A | 11/2000 | Gratz et al. | |
| 6,302,671 | B1 | 10/2001 | Gilfert et al. | |

* cited by examiner

*Primary Examiner*—Tri M. Mai
(74) *Attorney, Agent, or Firm*—Boyle Fredrickson Newholm Stein & Gratz S.C.

(57) ABSTRACT

A support structure is provided for supporting a plurality of cylindrical objects. The support structure includes an elongated member having first and second sides and first and second edges. First and second rib sections extend from the first side of the elongated member. The rib sections are generally parallel to each other and are spaced from corresponding edges of the elongated member. Each rib section includes an alternating series of arches and depressions.

8 Claims, 8 Drawing Sheets

TWO-SIDED ROLL SUPPORT WITH MULTIPLE RIBS

RELATED APPLICATION

This is a continuation-in-part of Ser. No. 09/836,769, filed Apr. 17, 2001 now U.S. Pat. No. 7,044,358 and entitled "Two-Sided Roll Support With Multiple Ribs."

FIELD OF THE INVENTION

The present invention relates generally to packaging elements, and in particular, to a support structure for supporting and spacing cylindrical objects during shipment and storage.

BACKGROUND AND SUMMARY OF THE INVENTION

Web materials such as plastic film are used for a variety of purposes including the sealing of other materials. Web materials are typically fabricated in roll form and used in their particular applications in the same form. However, such cylindrical products are often difficult to transport because they can become displaced relatively easily when subject to the conditions of roadway travel. In addition, it is undesirable to stack heavy cylindrical objects directly on one another because their weight can cause deformation. For those reasons, cylindrical objects such as web rolls are ordinarily retained by supports that space adjacent ones apart and prevent rolling movement. Such supports must be fabricated so that product damage is minimized. Failure to minimize damage during transport can cause defects that prevent use of the product for its intended purpose. Further, since it is most efficient to stack multiple layers of product for a single transport effort, the support must be strong enough to enable multi-layered stacking that does not cause product deformation.

Some supports for cylindrical products have been fabricated of polystyrene. The polystyrene supports generally provide sufficient strength to adequately protect a plurality of web rolls, for example, stacked together for transport. However, it is well known that polystyrene and other polymeric-based products are generally perceived as environmentally undesirable in that they are stable and unlikely to degrade over a long period. For that reason, there has been increasing interest in fabricating such web supports, and other sorts of packaging for that matter, from more environmentally friendly materials, including recyclable materials, such as molded pulp. Examples of molded pulp supports are described in U.S. Pat. Nos. 5,899,331 and 5,934,467. Those references describe molded roll supports having recesses and depressions that provide structural strength to the rolls and that also provide retention sites for cradling the rolls to be transported.

For the most part, present molded supports have only one side (the smooth side) configured to support products having cylindrical characteristics, while the other side (the rough side) is designed to provide suitable structural support. In order to enable multi-layer stacking, the support structures are formed of pairs of molded supports pivotably connected. The pair of molded supports pivot onto each other so that the smooth sides face outwardly, while the rough sides are placed back-to-back. In that way, the rolls to be supported come in contact only with the smooth sides of the double-hinged, support structure Unfortunately, the support structures that presently exist are not completely effective in preventing roll damage during transport. Specifically, the materials from which the support structures are molded have some compressibility so that when a plurality of relatively heavy objects are placed on a support structure, there is some thickness reduction. In addition, it is ordinary practice for transporters to place banding straps around the perimeter of a stack of objects. The banding is tightened to prevent individual objects in the stack from slipping. However, that tightening causes additional compression of the support material, particularly the hinged support structures. During transport, that additional compression that occurs after banding can result in less than complete retention of individual objects. As a result, the banding loosens and the objects become prone to spinning and other forms of displacement that can result in damage.

Further, the folding of pairs of molded supports to form the support structures is labor intensive. As such, the labor cost associated with using these types of support structures can be significant for the end users thereof. In addition, since the support structures are formed from pairs of molded supports folded onto each other, material cost becomes a significant portion of the overall cost of each support structure thereby increasing the overall cost of utilizing support structures to the end user. As such, it is desirable to provide a support structure which is formed from less material, and which is less expensive to manufacture than prior support structure.

In addition to increasing the overall cost of the support structure, the folding of the molded supports formed to the support structure creates two additional problems. First, the folded support structures have a tendency to unfold during the stacking of the cylindrical objects thereon. As a result, the stacking of the cylindrical objects on the support structures may become a difficult and time consuming task. Second, it is a common problem when folding the molded supports to misalign the supports such that the backs of such supports do not properly overlap. The misalignment of the molded supports on the cylindrical objects allows the cylindrical objects to shift back and forth during transport. As a result, the cylindrical objects supported by the improperly folded molded supports may be damaged.

Therefore, it is a primary object and feature of the present invention to provide a support structure for supporting cylindrical objects during transport.

It is a further object and feature of the present invention to provide a support structure for supporting cylindrical objects during transport that may be manufactured from a plurality of different materials, including molded pulp.

It is still a further object and feature of the present invention to provide a support structure for supporting cylindrical objects during transport that is formed from less material than prior support structures and that does not need to be configured by the end user after manufacture.

In accordance with the present invention, a support structure is provided for supporting an object. The support structure includes an elongated member extending along a longitudinal axis and having first and second sides and first and second edges. A first set of ribs projects from the first side of an elongated member that corresponds to a first set of depressions in the second side of the elongated member. The first set of ribs includes first and second ribs axially spaced from each other and from corresponding edges of the elongated member along an axis transverse to the longitudinal axis. A second set of ribs projects from the first side of the elongated member at a location axially spaced from the first set of ribs so as to define an object receiving cradle between. The second set of ribs includes first and second ribs axially spaced from each other along a second axis transverse to the longitudinal axis of the elongated member.

First and second ribs of the second set of ribs are axially spaced from corresponding edges of the elongated member along the second axis. It is contemplated that the support structure further include a first rib projecting from the second side of the elongated member which corresponds to a first depression on the first side of the elongated member between first and second ribs of the first set of ribs. A second rib projects from the second side of the elongated member at a location axially spaced from the first rib projecting from the second side of the elongated member so as to define a second side object receiving cradle therebetween. The second rib projecting from the second side elongated member corresponds to a second depression in the first side of the elongated member between the first and second ribs of the second set of ribs.

The first and second set of ribs of the first set of ribs and the second set of ribs have a predetermined height. In addition, the first and second ribs projecting from the second side of the elongated member have a predetermined height. The predetermined height of the first and second ribs of the first set of ribs and of the first and second ribs of the second set of ribs is generally equal to the predetermined height of the first and second set of ribs projecting from the second side of the elongated member.

The support structure may include a third set of ribs projecting from the first side of the elongated member at a location axially spaced from the second set of ribs so as to define a second object receiving cradle therebetween. The third set of ribs includes first and second ribs axially spaced from each other along a third axis transverse to the longitudinal axis of the elongated member. The first set of ribs projecting from the first side of the elongated member may include a first depression formed therein between the first and second ribs of the first set of ribs. The first depression corresponds to a first rib projecting from the second side of the elongated member. Further, the first side of the elongated member may include a second depression formed therein between the first and second ribs of the second set of ribs. The second depression corresponds to a second rib projecting from the second side of the elongated member. The first and second set of ribs projecting from the second side of the elongated member define a second side object receiving cradle therebetween.

In accordance with a further aspect of the present invention, a support structure is provided for supporting an object. The support structure includes an elongated member extending along a longitudinal axis and having first and second sides, first and second edges, and first and second ends. The first side of the elongated member includes a first plurality of ribs projecting therefrom, a second plurality of ribs projecting therefrom and a plurality of depressions formed therein. The first plurality of ribs are spaced between first and second ends along a first axis. Each of the first plurality of ribs are laterally spaced from the first edge. The second plurality of ribs are also spaced between the first and second ends along a second axis. Each of the second plurality of ribs is laterally spaced from the second edge. The plurality of depressions are spaced between the first and second ends along the third axis deposed between the first and second axis. Each of the first plurality of ribs is aligned with a corresponding rib of the second plurality of ribs along a corresponding axis transverse to the longitudinal axis of the corresponding elongated member. Each of the plurality of depressions is disposed between one of the first plurality of ribs and one of the second plurality of ribs. Each of the plurality of depressions forms a corresponding rib projecting from the second side of the elongated member. The ribs projecting from the second side of the elongated member are spaced between the first and second ends along the third axis. The ribs projecting from the second side of the elongated member include a first rib and a second rib. The first rib and the second rib define the second side object receiving cradle therebetween. The first plurality of ribs projecting from the first side of the elongated member includes a first rib and a second rib. The first rib and the second rib partially define a first object receiving cradle therebetween. The second plurality of ribs projecting from the first side of the elongated member also includes a first rib and a second rib. The first rib and the second rib of the second plurality of ribs partially define the first object receiving cradle therebetween.

In accordance with a still further object and feature of the present invention, a support structure is provided for supporting a plurality of objects. The support structure includes an elongated member having first and second sides and first and second edges. First and second rib sections extend from the first side of the elongated member and are generally parallel to each other. Each rib section is spaced from a corresponding edge of the elongated member and includes an alternating series of arches and depressions.

The arches and depressions of each of the rib sections are aligned with each other. It is further contemplated that a first rib section extend from the second side of the elongated member. The first rib section extending from the second side of the elongated member is spaced from the edges of the elongated member and includes an alternating series of arches and depressions. The elongated member is preferably formed of molded pulp.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE INVENTION

Figure 1:
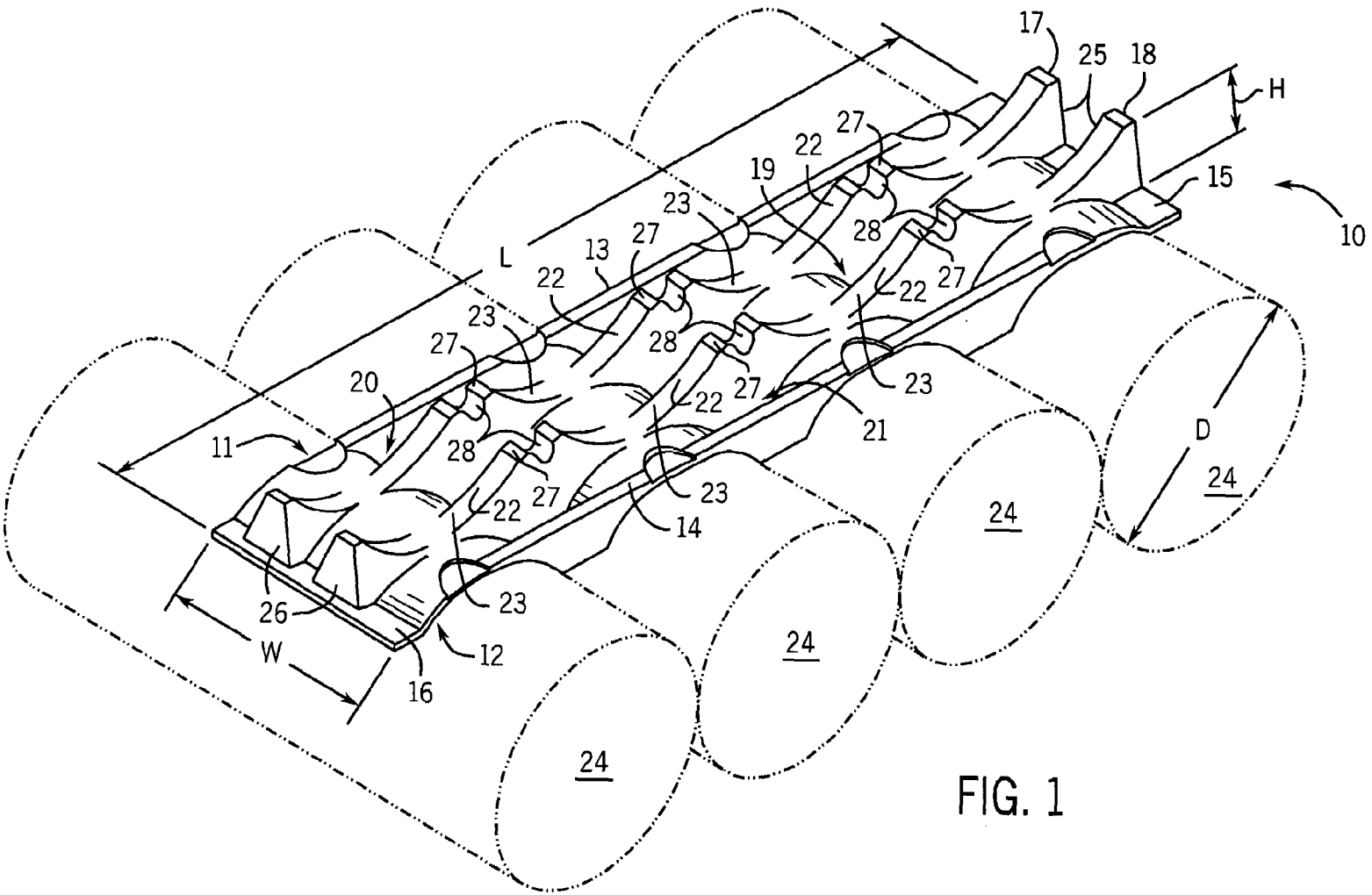
FIG. 1 is a simplified perspective view of the first side of the support of the present invention shown on a plurality of rolls supported by the second side thereof.
Figure 2:
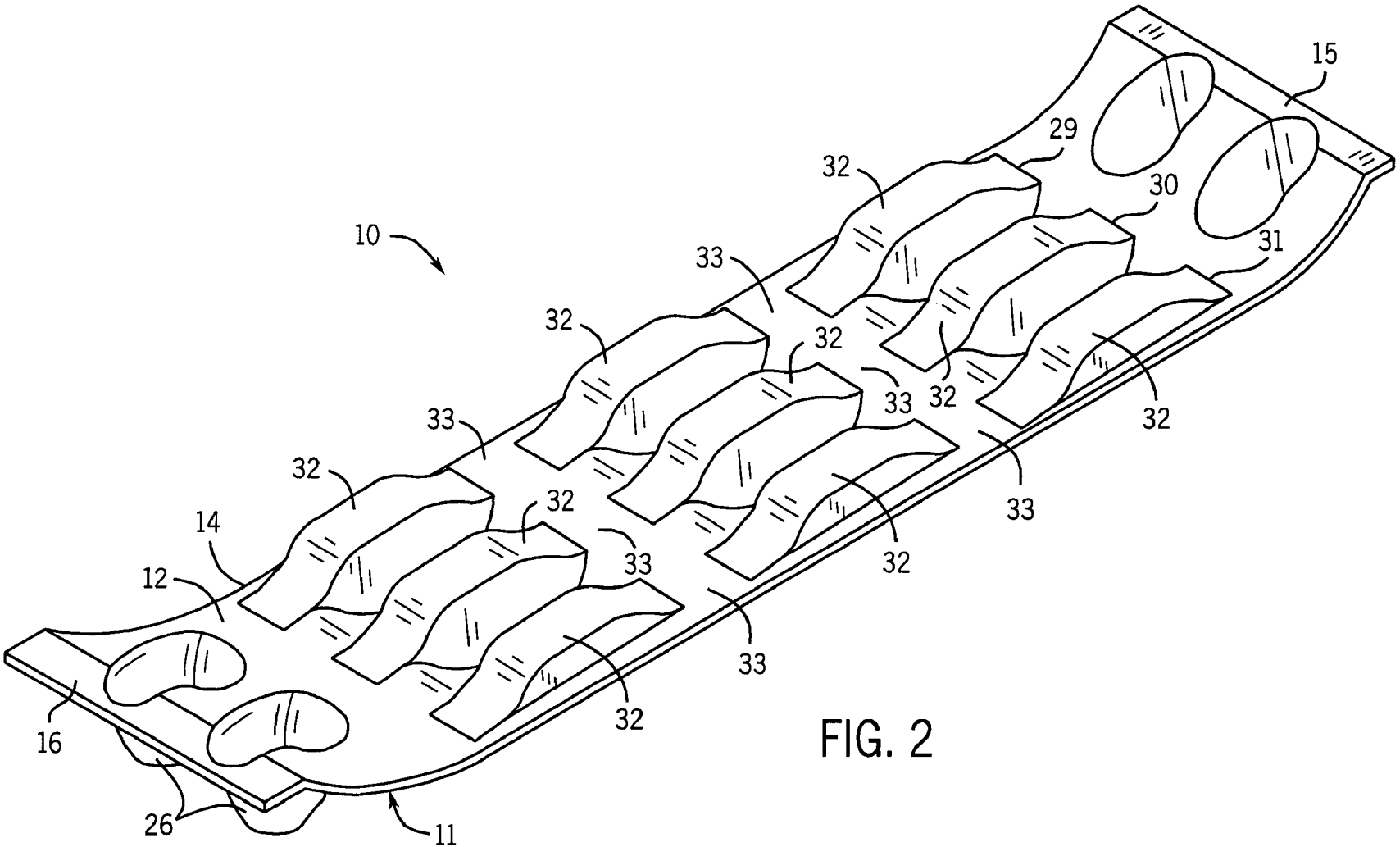
FIG. 2 is a simplified perspective view of the second side of the support of the present invention shown without the plurality of rolls thereon.

An object support structure 10 of the present invention is shown in FIGS. 1 and 2. The structures includes a first side 11 and an opposing second side 12. Either or both of the two sides may be molded with a smooth design or a rough design. The structure 10 is preferably fabricated of moldable pulp fiber material but may also be fabricated on non-metallic polymeric materials, such as plastic sheet, for example. The structure 10 is of selectable length L and width W sufficient to ensure that two spaced rib sections may be established on said first side 11. The first side 11 includes opposing first sidewalls 13 and 14 and two opposing end-walls 15 and 16. The sidewalls and endwalls define the perimeter of the elongate structure that is the roll support structure 10.

The structure 10 includes on the first side 11 a first rib section 17 and a second rib section 18 that is substantially parallel to the first rib section 17, The first rib section 17 and the second rib section 18 are spaced apart from one another by an inner valley 19 and they are spaced from the sidewalls 13 and 14 by outer valleys 20 and 21, respectively. All of the valleys are preferably of substantially the same configuration. Each of the rib sections 17 and 18 includes an alternating series of two or more interior arches 22 and semi-cylindrical depressions 23. The arches 22 and the depressions 23 are preferably sized and configured to retain securely within the depressions 23 rolls 24 so that the contact are of the depressions 23 to the rolls 24 is substantial. Although the rolls of web material are shown being retained by the support 10, it is to be understood that the support 10 may be employed to retain other objects having cylindrical design.

Continuing with the example, for a roll having a diameter D, the completed circle defined by the circumference of the depressions 23 preferably has a diameter greater than D and the arches 22 are of a height sufficient to produce adequate contact with the rolls 24. For example, for a roll having a diameter equal to about 10", the arches 22 should be at a height of at least about 1.75". It is to be noted that at least the depressions 23 of the respective rib sections 17 and 18 are to be substantially aligned with one another so that the rolls 24 may reside therein.

With continuing reference to FIG. 1, the first side 11 of the structure 10 further includes a first set of end arches 25 and a second set of end arches 26 that are adjacent to and form a part of endwalls 15 and 16, respectively. They are preferably about the same height as the arches 22, but in some instances may be taller if desired. Additionally, the inner arches 22 preferably each includes a land 27 that defines the height of the respective inner arches. Each land 27 provides structural reinforcement to the rib sections 17 and 18 and has a substantially centered cavity 28 spaced between two top sections of the individual lands 27. These cavities 28 enhance the structural characteristics of the individual arches 22, preventing excessive compression of that portion of the structure 10, particularly in the center of the structure 10 during full loading.

As illustrated in FIG. 2, the second side 12 of the structure 10 is a modified inverted version of the first side 11. In particular, the second side 12 includes a set of parallel rib sections 29–31 that correspond to the valleys 19–21 of the first side 11. The rib sections 29–31 include a series of alternating peaks 32 and depressions 33. Although the peaks 32 may have lands, they do not in the preferred embodiment of the present invention, as that would affect the design of the first side 11 to an extent. The second side 12 is designed to retain within the aligned depressions 33 what would effectively be the topside of the rolls 24, essentially as shown in FIG. 1. On the other hand, the first side 11 is designed to retain thereon the underside of the rolls 24. The peaks 32 are sufficiently sized in height to aid in retaining the rolls within the depressions 33. It is to be noted that the rib sections 29–31 are spaced apart from one another by second side valleys that correspond to the underside configuration of the arches 22 and their lands 27 of the first side 11. The structure 10 of the present invention is relatively wider than corresponding supports of the prior art to ensure that multiple ribs may be fabricated into the second side 12. The wider design in combination with relatively taller ribs produces substantially greater critical surface area contact of the structure 10 with whatever objects are being supported thereon.

The roll support structure 10 of the present invention provides an improved support that enables the stacking and retention of cylindrical objects without resorting to double-configured structures. The structure 10 is formed of a single surface area contact. While the invention has been described with reference to a particular example embodiment, it is intended to cover all modifications and equivalents as described in the following claims.

Referring to FIGS. 3–10, a second support structure in accordance with the present invention is generally designated by the reference numeral 50. Support structure 50 includes first and second opposite sides 52 and 54, respectively. Support structure 50 extends along a longitudinal axis and includes first and second edges 56 and 58, respectively, and first and second ends 60 and 62, respectively. In the preferred embodiment, support structure 50 is fabricated from a molded pulp material. However, it is contemplated as to fabricate support structure 50 from other types of material without deviating from the scope of the present invention.

First side 52 of support structure 50 includes first and second generally parallel rib sections 64 and 65 extend along corresponding axis 51*a* and 51*b*, respectively, which are parallel to each other and to the longitudinal axis 51 of support member 50. Each rib section 64 and 65 includes first and second end ribs 68 and 70, respectively, positioned adjacent corresponding ends 60 and 62, respectively, of support structure 50. First end rib 68 includes land 69 which is spaced from side 52 of support structure 50 by first and second sidewalls 71 and 72, respectively. Sidewalls 71 and 72 of first end rib 64 are interconnected by end wall 74 which projects from first side 52 of support structure 50 and by an arcuate leading support surface 76. Second end rib 70 includes a land 78 spaced from first side 52 of support structure 50 by first and second sidewalls 80 and 82, respectively. Sidewalls 80 and 82 of second end rib 70 are interconnected by end wall 84 and by arcuate trailing support surface 86.

Each rib section 64 and 65 further includes a plurality of intermediate ribs 88 which are longitudinally spaced between corresponding first and second end ribs 68 and 70, respectively of support structure 50. Each intermediate rib 88 includes first and second lands 90 and 92, respectively, lying in a common plane and spaced from first side 52 of support structure 50 by first and second sidewalls 94 and 96, respectively. Arcuate valley 98 is formed between corresponding first and second sidewalls 94 and 96, respectively, and interconnects first and second lands 90 and 92, respectively, of each intermediate rib 88. Each intermediate rib 88 further includes a generally arcuate trailing surface 100 which is positioned between first and second sidewalls 94 and 96, respectively, thereof and which extends upwardly from first side 52 of support structure 50 to intersect first land 90. In addition, each intermediate rib 88 includes a generally arcuate leading surface 102 which is positioned between first and second sidewalls 94 and 96, respectively, thereof and which extends upwardly from first side 52 of support structure 50 to intersect second land 92.

Figure 3:
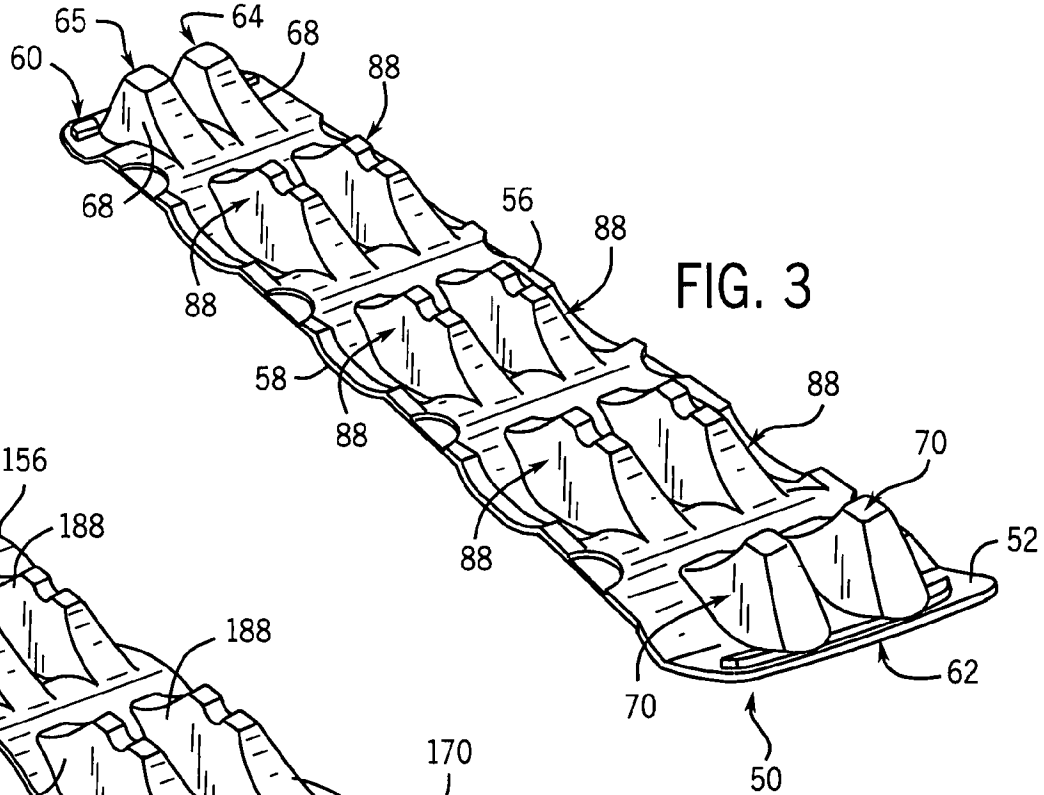
FIG. 3 is an isometric view of a second embodiment of a support structure in accordance with the present invention.
Figure 11:
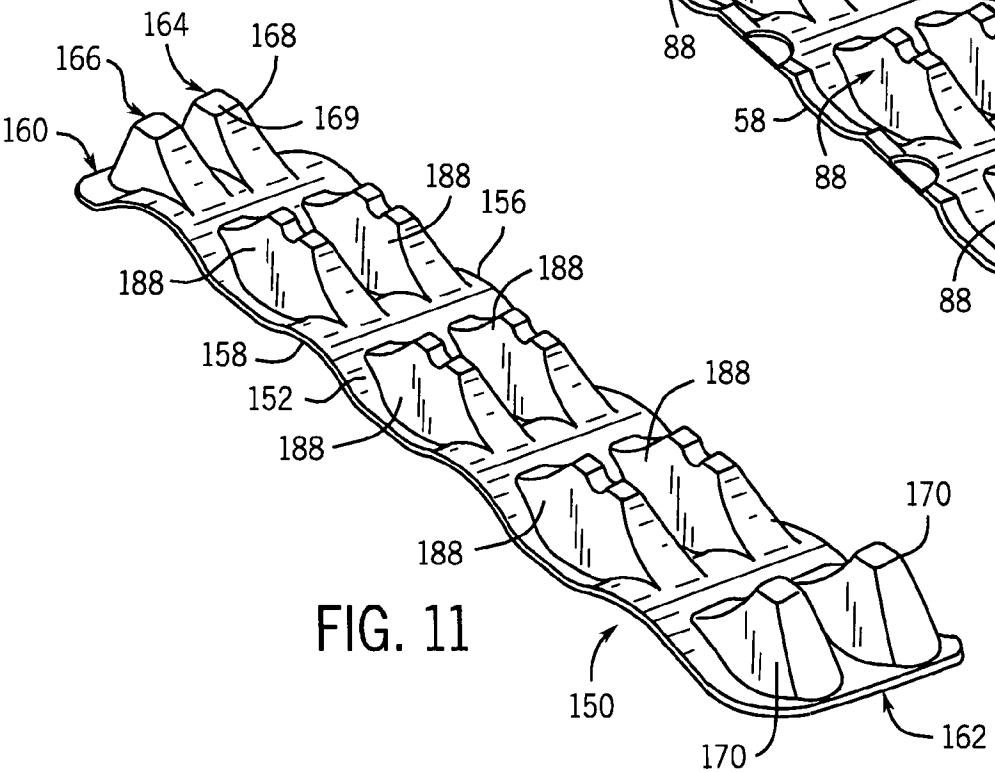
FIG. 11 is an isometric view of a third embodiment of a support structure in accordance with the present invention.
Figure 4:
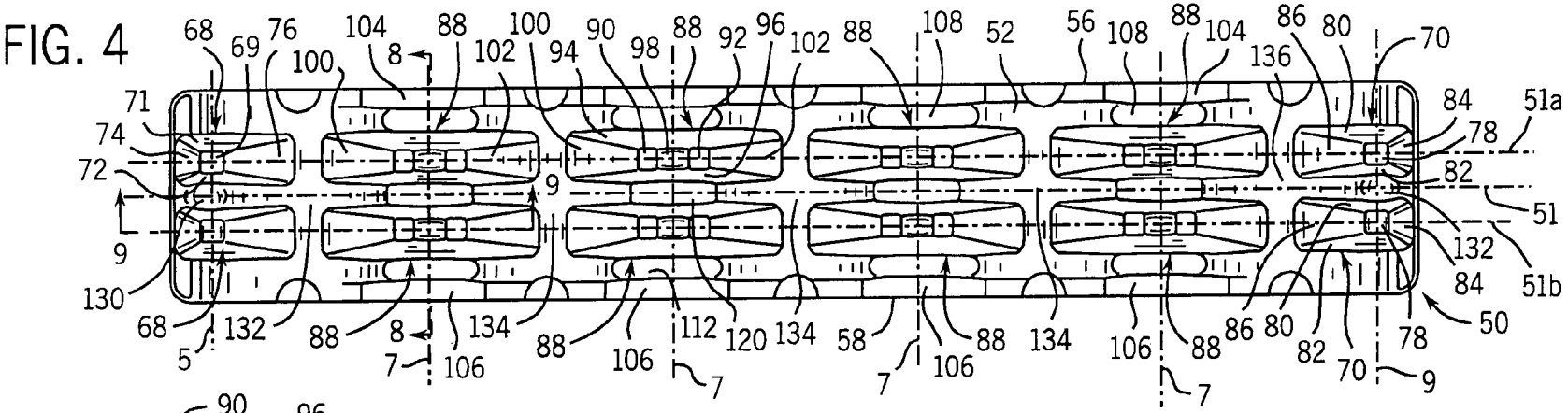
FIG. 4 is a top plan view of the support structure of FIG. 3.
Figure 8:
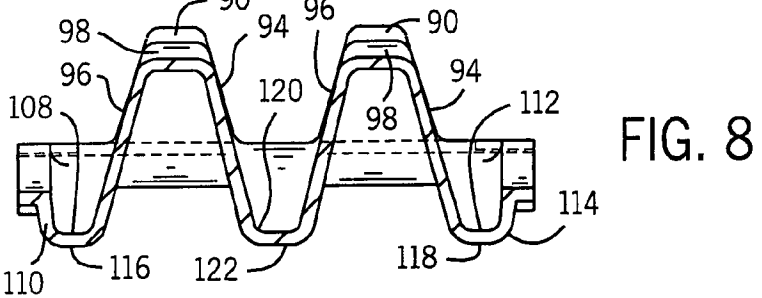
FIG. 8 is a cross-sectional view taken along line 8—8 of FIG. 4.

As best seen in FIGS. 3–4, the pair of end ribs 68 of rib sections 64 and 65 are axially aligned along axis 5 with each other along an axis transverse to the longitudinal axis of support structure 50. In addition, each intermediate rib 88 of rib section 64 is axially aligned with a corresponding intermediate rib 88 of second rib section 65 along corresponding axis 7 and end rib 70 of rib section 64 is axially aligned with end rib 70 of rib section 65 along axis 9. As such, it can be appreciated that rib sections 64 and 65 are generally parallel to each other and to edges 56 and 58 of support structure 50.

A plurality of longitudinally-spaced arches 104 are formed in edge 56 of support member 50. Similarly, a plurality of longitudinally-spaced arches 106 are formed in edge 58 of support structure 50. Each arch in edge 56 is aligned with a corresponding intermediate rib of rib sections 64 and 65, as well as, a corresponding arch 106 in edge 58 of support structure 50.

Depressions 108 are formed between arches 104 in edge 56 of support structure 50 and first sides 94 of corresponding intermediate ribs 88. Depressions 108 in first side 52 of support structure 50 correspond to ribs 110 extending from second side 54 of support member 50, FIG. 5. Additionally, depressions 112 are formed in first side 52 of support structure 50 between arches 106 in edge 58 of support structure 50 and second side 96 of corresponding intermediate ribs 88. Depressions 112 in first side 52 of support structure 50 correspond to ribs 114 projecting from second side 54 of support structure 50. Ribs 110 are spaced along and lie on a common axis so as to define a first rib section 116 on second side of 54 of support structure 50. Similarly, ribs 114 are spaced along and lie on a common axis so as to define a second rib section 118 projecting from second side 54 of support member 50. It can be appreciated that rib sections 116 and 118 projecting from second side 54 of support member 50 are generally parallel to each other and to edges 56 and 58 of support member 50.

First side 52 of support member 50 further includes depressions 120 formed between second sidewalls 96 of intermediate ribs 88 of rib section 64 and corresponding first sidewalls 94 of intermediate ribs 88 of second rib section 65. Depressions 120 in first side 52 of support structure 50 correspond to ribs 122 projecting from second side 54 of support member 50. Ribs 122 are longitudinally spaced and lie on a common axis so as to define a third rib section 124 projecting from second side 54 of support member 50. Third rib section 124 projecting from second side 54 of support member 50 is generally parallel to first and second rib sections 116 and 118, respectively.

Rib section 124 further includes first and second end ribs 126 and 128 which project from second side 54 of support structure 50 and lie on a common axis with ribs 122. First end rib 126 is positioned adjacent first end 60 of support member 50 and corresponds to a depression 130 in first side 52 of support member 50. Depression 130 is positioned between second sidewall 72 of first end rib 68 of first rib section 64 projecting from first side 52 of support member 50 and first sidewall 71 of first end rib 68 of second rib section 65 projecting from first side 52 of support member 50. Second end rib 128 projecting from second side 54 of support member 50 corresponds to depression 132 in first side 52 of support member 50. Depression 132 is formed between second sidewall 82 of second end rib 70 of first rib section 64 projecting from first side 52 of support member 50 and first sidewall 80 of second end rib 70 of second rib section 65 projecting from first side 52 of support member 50.

As described, the leading surfaces 76 of end ribs 68 of rib sections 64 and 65 and the trailing surfaces 100 of intermediate ribs 88 of rib sections 64 and 65 define a first end roll receiving cradle 132 therebetween on first side 52 of support member 50. Leading surfaces 102 of intermediate members 88 of rib sections 64 and 65 and trailing surfaces 100 of adjacent intermediate ribs 88 of rib sections 64 and 65 define intermediate roll receiving cradles 134 on first side 52 of support member 50. In addition, leading surfaces 102 of intermediate ribs 88 of rib sections 64 and 65 and adjacent trailing surfaces 86 of second end ribs 70 of rib sections 64 and 65 define second end roll receiving cradle 136 therebetween.

First end rib 126 and adjacent rib 122 of rib section 124 define a first end, second side roll receiving cradle 138 therebetween. Further, ribs 110, 122 and 114 of rib sections 116, 124 and 118, respectively, and adjacent ribs 110, 122 and 114 of rib sections 116, 124 and 118, respectively, define intermediate, second side roll receiving cradles 140 therebetween. In addition, rib 122 of rib section 124 and adjacent second end rib 128 of rib section 124 define a second end, second side roll receiving cradle 142 therebetween.

Figure 9:
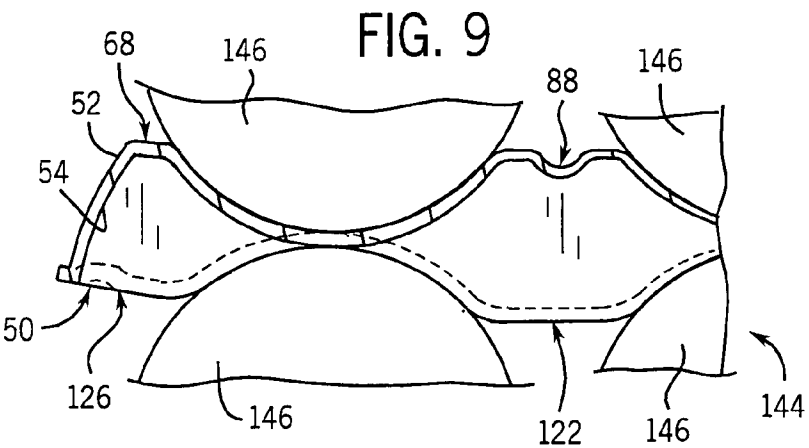
FIG. 9 is a cross-sectional view taken along line 9—9 of FIG. 4.
Figure 10:
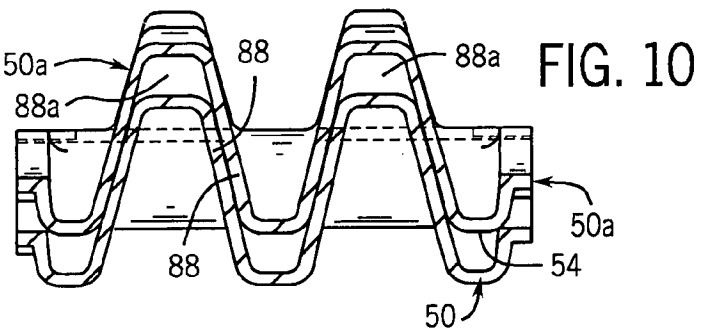
FIG. 10 is a cross-sectional view showing first and second support structures in a nested relationship.
Figure 5:
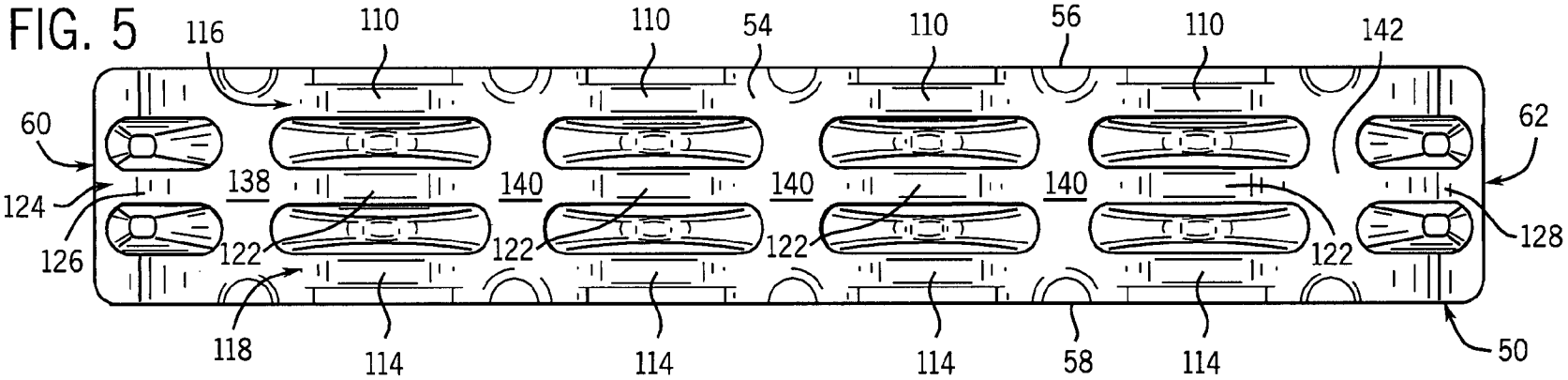
FIG. 5 is a bottom plan view of the support structure of FIG. 3.
Figure 13:
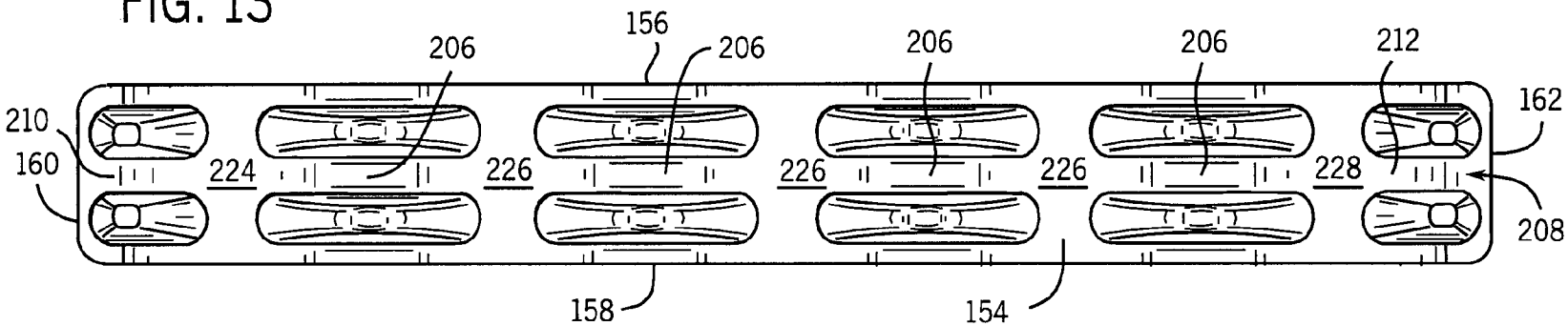
FIG. 13 is a bottom plan view of the support structure of FIG. 11.
Figure 6:
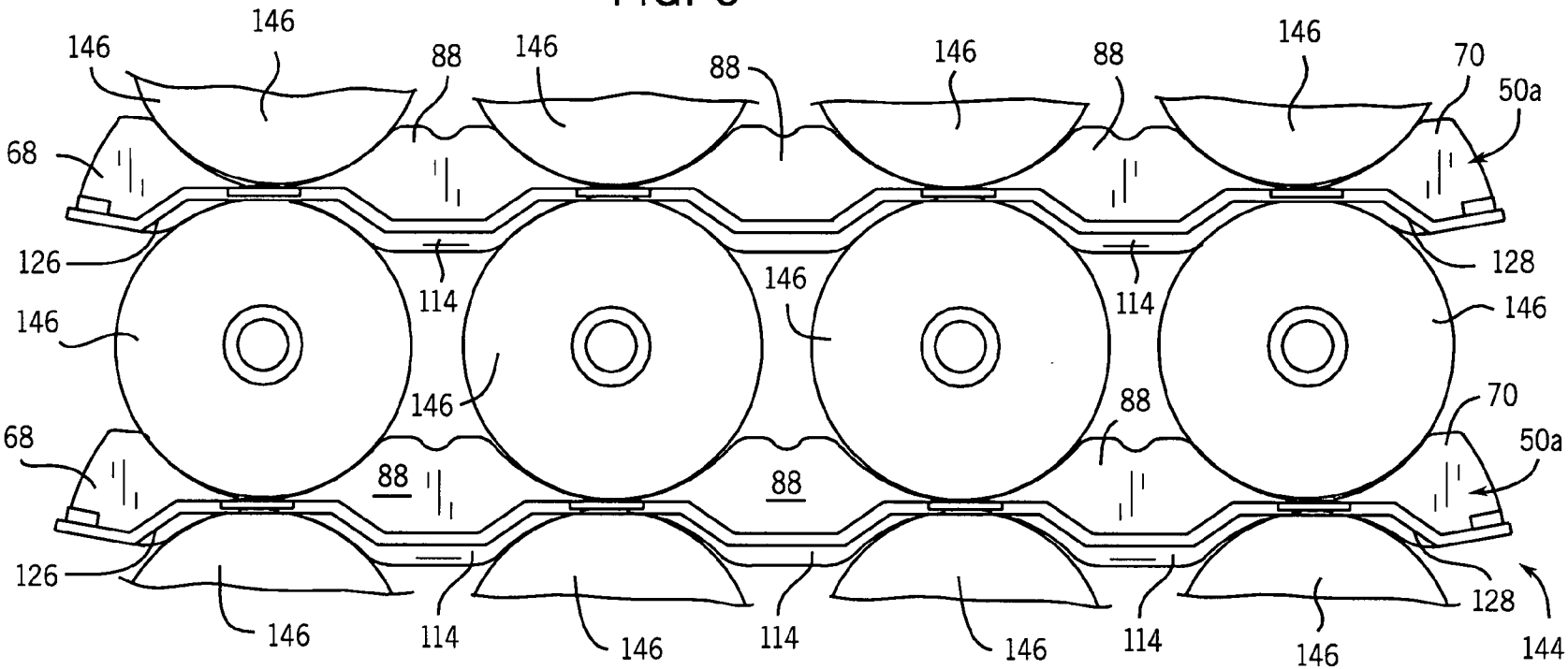
FIG. 6 is a side elevational view showing a portion of a stack incorporating a plurality of support structures in accordance with the present invention.
Figure 7:
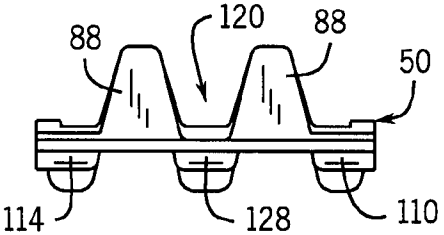
FIG. 7 is an end view showing of the support structure of FIG. 3.

In order to form a stack 144, FIGS. 6 and 9, support member 50 is positioned on a supporting surface such as a pallet, floor or the like. Cylindrical rolls 146 are positioned within first end roll receiving cradle 132, intermediate roll receiving cradles 134 and second end roll receiving cradle 136 on first side 52 of support member 50. Thereafter, a second support member 50*a* is positioned on cylindrical rolls 146 such that first end, second side roll receiving cradle 138 receives the upper portion of cylindrical roll 146 positioned within first end roll receiving cradle 132 of support member 50. In addition, intermediate, second side roll receiving cradles 140 on second side 54 of support member 50 receive the upper portions of cylindrical rolls 146 within intermediate roll receiving cradles 140 on first side 52 of support member 50. Second end, second side roll receiving cradle 142 on second side 54 of support member 50*a* receives the upper portion of cylindrical roll 146 within second end roll receiving cradle 136. Thereafter, additional cylindrical rolls 146 may be positioned within first end roll receiving cradle 132, intermediate roll receiving cradles 134, and second end roll receiving cradle 136 on first side 52 of support member 50*a*. An additional support member 50*b* is positioned on such support rolls 146 as heretofore described and the process is repeated in order to build stack 144.

Referring to FIGS. 11–16, a third support structure in accordance with the present invention is generally designated by the reference numeral 150. Support structure 150 extends along longitudinal axis and includes first and second opposite sides 152 and 154, respectively. Support structure 150 extends along longitudinal axis and includes first and second edges 156 and 158, respectively, first and second ends 160 and 162, respectively. In a preferred embodiment, support structure 150 is fabricated from molded pulp material, however, it is contemplated as to fabricate support structure 150 from other types of material without deviating from the scope of the present invention. First side 152 of support structure 150 includes first and second generally rib sections 164 and 166, respectively, which are parallel to each other and to the longitudinal axis 151 of support member 150. Each rib section 164 and 166 includes first and second end ribs 168 and 170, respectively, positioned adjacent corresponding ends 160 and 162, respectively, of support structure 150. First end rib 168 includes land 169 which is spaced from side 152 of support structure 150 by first and second sidewalls 171 and 172, respectively. Sidewalls 171 and 172 of first end rib 168 are interconnected by end wall 174 which projects from first side 152 of support structure 150 and by an arcuate leading support surface 176. Second end rib 170 include a land 178 spaced from first side 52 of support structure 150 by first and second sidewalls 180 and 182, respectively. Sidewalls 180 and 182 of second end rib 170 are interconnected by end wall 184 and by arcuate trailing support surface 186. Each rib section 164 and 166 further includes a plurality of intermediate ribs 188 which are longitudinally spaced between corresponding first and second end ribs 168 and 170, respectively, of rib sections 164 and 166 support structure 150. Each intermediate rib 188 includes first and second lands 190 and 192, respectively, lying in a common plane and spaced from first side 152 of support structure 150 by first and second sidewalls 194 and 196, respectively. Arcuate valley 198 is formed between corresponding first and second sidewalls 194 and 196, respectively, and interconnects first and second ends 190 and 192, respectively, of each intermediate rib 188. Each intermediate rib 188 further includes a generally arcuate trailing surface 200 which is positioned between first and second sidewalls 194 and 196, respectively, thereof and which extends upwardly from first side 152 of support structure 150 to intersect first land 190. Each intermediate rib includes a generally arcuate leading surface 202 which is positioned between first and second sidewalls 194 and 196, respectively, thereof and which extends upwardly from first side 152 of support structure 150 and intersects second land 192.

Figure 12:
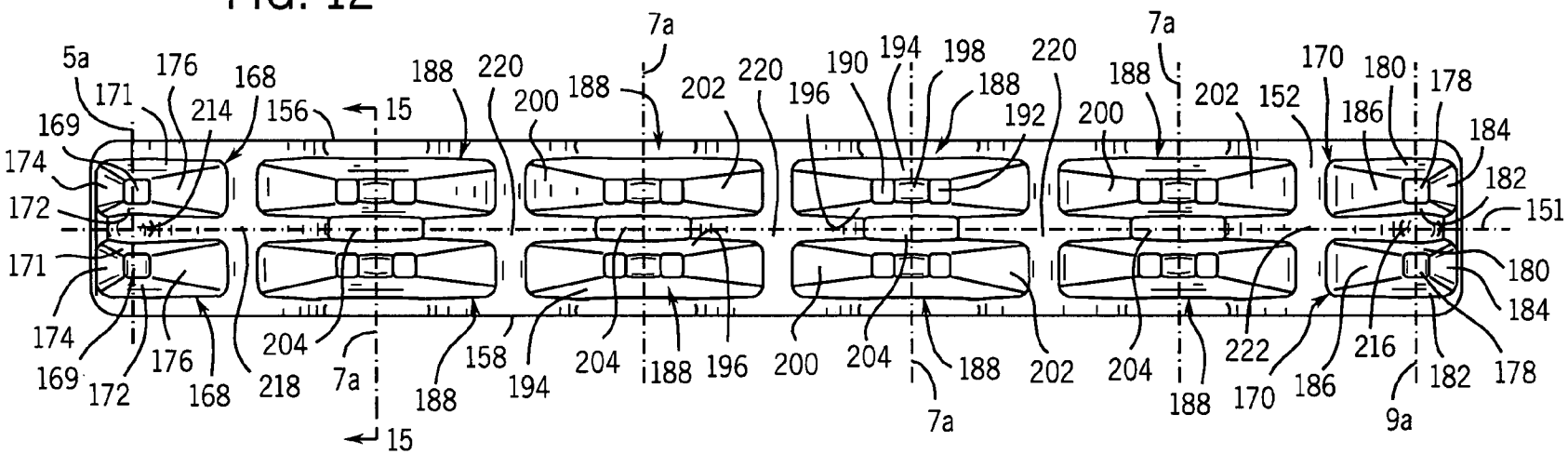
FIG. 12 is a top plan view of the support structure of FIG. 11.

As best seen in FIG. 12, the pair of end ribs 168 of rib sections 164 and 166 are axially aligned with each other along an axis 5*a* transverse to the longitudinal axis of support structure 150. In addition, each intermediate rib 188 of rib section 164 is axially aligned with a corresponding intermediate rib 188 of rib section 166 along corresponding axis 7*a* and end rib 170 of rib section 164 is axially aligned with end rib 170 of rib section 166 along axis 9*a*. As such, it can appreciated the rib sections 164 and 166 are generally parallel to each other and to edges 156 and 158 of support structure 150.

First side 152 of support member 150 further includes depressions 204 formed between second sidewalls 196 of intermediate ribs 188 of rib section 164 and corresponding first sidewalls 194 of intermediate ribs 88 of second rib section 166. Depressions 204 in first side 152 of support structure 150 correspond to ribs 206 projecting from second side 154 of support member 150. Ribs 266 are longitudinally spaced and lie in a common axis so as to define a first rib section 208 projecting from second side 154 of support member 150. First rib section 208 further includes first and second end ribs 210 and 212, respectively, which project from second side 154 of support structure 150 and lie on a common axis with ribs 206. First end rib 210 is positioned adjacent first end 160 of support member 150 and corresponds to a depression 214 in first side 152 of support member 150. Depression 214 is positioned between second sidewall 172 of first end rib 168 of first rib section 164 projecting from first side 152 of support member 150 and first sidewall 171 of first end rib 168 of second rib section 166 projecting from first side 152 of support member 150. Second end rib 212 projecting from second side 154 of support member 150 corresponds to depression 216 in first side 152 of support member 150. Depression 216 is formed between second sidewall 182 of second rib 170 of first rib section 164 projecting from first side 152 of support member 150 and first sidewall 180 of second end rib 170 of second rib section 166 projecting from first side 152 of support member 150. As described, leading surfaces 176 of first end ribs 168 of rib sections 164 and 166 and the trailing surfaces 200 of intermediate ribs 188 of rib sections 164 and 166 define a first end roll receiving cavity 218 therebetween on first side 152 of support member 150. Leading surfaces 202 of intermediate members 188 of rib sections 164 and 166 and trailing surfaces 200 of adjacent intermediate ribs 188 of rib sections 164 and 166 define intermediate roll receiving cradles 220 of first side 152 of support member 150. In addition, leading surfaces 202 of intermediate ribs 188 of rib sections 164 and 166 and adjacent trailing surfaces 186 of second end ribs 170 of rib section 164 and 166 define second end roll receiving cradle 222 therebetween.

First end rib 210 and adjacent rib 206 of rib section 208 on second side 154 of support member 150 define a first end, second side roll receiving cradle 224 therebetween. Adjacent ribs 206 of rib section 208 define intermediate, second side roll receiving cradles 226 therebetween. Rib 206 and adjacent second end rib 212 of rib section 208 define a second end, second side roll receiving cradle 228 therebetween.

Figure 14:
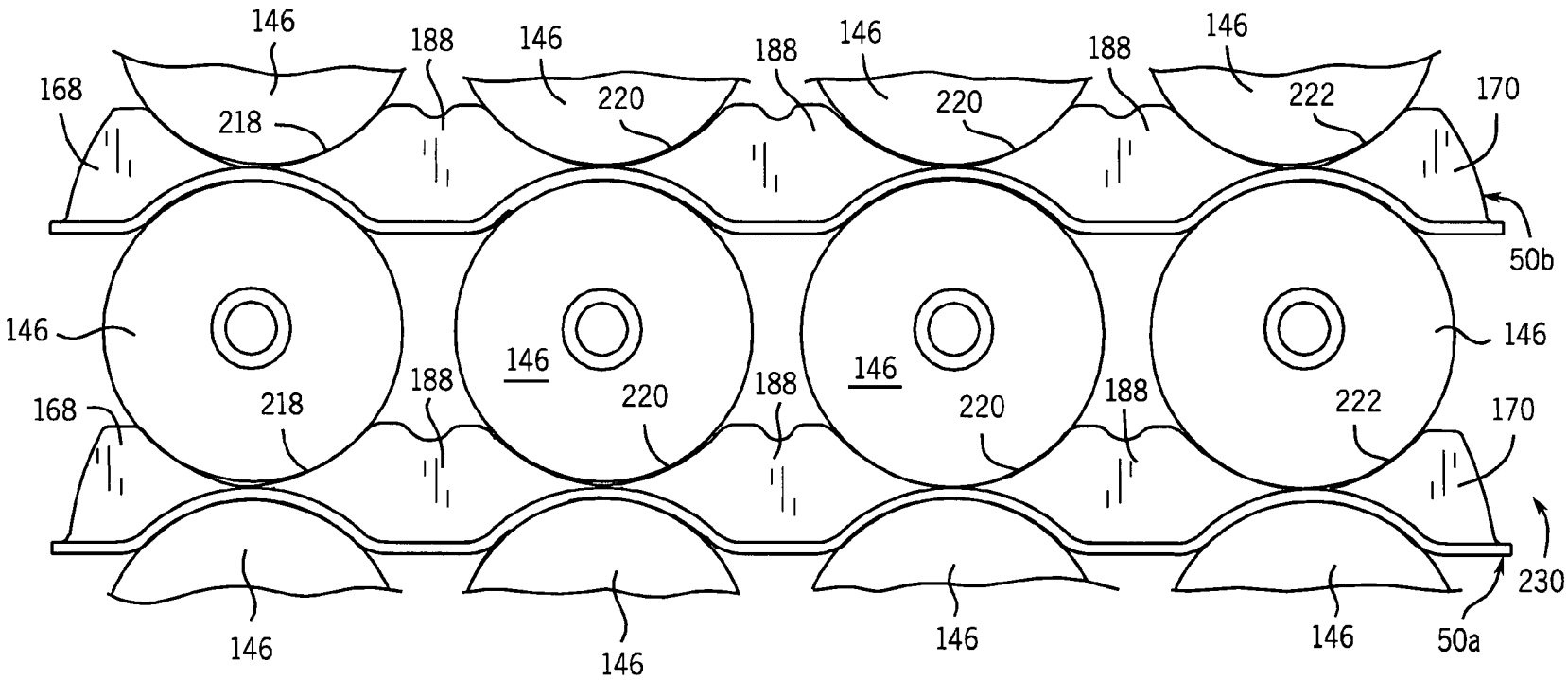
FIG. 14 is a side elevational view of a stack incorporating the support structures of FIG. 11

In order to form a stack 230, FIG. 14, support member 150 is positioned on a displaying surface such as a pallet, flow or the like. Cylindrical rolls 146 are positioned within first end roll receiving cradle 218, intermediate roll receiving cradles 220 and second end roll receiving cradle 222 on first side 152 of support member 150. Thereafter, a second support member 150*a* is positioned on cylindrical rolls 146 such that first end, second side roll receiving cradle 224 receives upper portion of cylindrical roll 146 positioned within first end roll receiving cradle 218 of support member 150. In addition, intermediate, second side roll receiving cradle 226 on second side 154 of support member 150 receive the upper portions of cylindrical rolls 146 within intermediate roll receiving cradles 220 on first side 152 of support member 150. Second end, second side roll receiving cradle 228 on second side 154 of support member 150*a* receives the upper portion of cylindrical roll 146 within second end roll receiving cradle 222. Thereafter, additional cylindrical rolls may be positioned within first end roll receiving cradle 218, intermediate roll receiving cradles 220 and second end roll receiving cradle 222 on first side 152 of support member 150*a*. Additional support member 50*b* may be positioned on such support rolls as heretofore described and the process is repeated in order to build stack 230.

Figure 16:
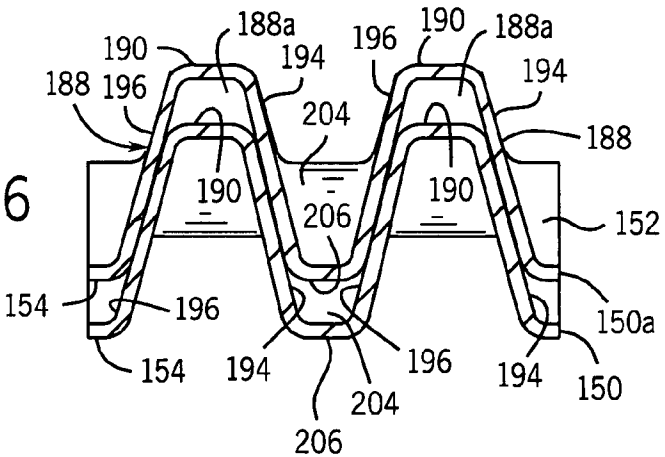
FIG. 16 is a cross-sectional view taken along line 16—16 of FIG. 12 showing first and second support structures in a nested relationship.
Figure 15:
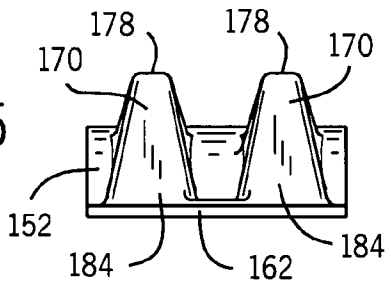
FIG. 15 is an end view of the support structure of FIG. 8.

Referring to FIG. 16, when not in use, support members 150 may be stacked upon each other in a nested relationship to conserve space and to facilitate transport of support members 150 to a desired location. When nesting, intermediate ribs 188 of lower support member 150 are received within corresponding recesses 188*a* in second side 154 of upper support member 150*a* which, in turn, correspond to intermediate ribs 188 on first side 152 of support member 150*a*.

Various modes of carrying out the invention are contemplated as being within the scope of the following claims particularly pointing and distinctly claiming the subject matter which is regarded as the invention.

I claim:

1. A support structure for supporting an object, comprising:

an elongated member extending along a longitudinal axis and having first and second sides, first and second edges, and a thickness;

a first set of ribs projecting from the first side of the elongated member and corresponding to a first set of depressions in the second side of the elongated member, the first set of ribs including first and second ribs axially spaced from each other and from corresponding edges of the elongated member along a first axis transverse to the longitudinal axis;

a second set of ribs projecting from the first side of the elongated member at a location axially spaced from the first set of ribs so as to define a first object receiving cradle therebetween, the second set of ribs including first and second ribs axially spaced from each other along a second axis transverse to the longitudinal axis of the elongated member;

a first rib projecting from the second side of the elongated member and corresponding to a first depression in the first side of the elongated member between the first and second ribs of the first set of ribs; and a second rib projecting from the second side of the elongated member at a location axially spaced from the first rib projecting from the second side of the elongated member so as to define a second side object receiving cradle therebetween, the second rib projecting from the second side of the elongated member corresponding to a second depression in the first side of the elongated member between the first and second ribs of the second set of ribs;

wherein:

the first object receiving cradle opens in a first direction and the second side object receiving cradle opens in a second direction opposite to the first direction;

the first object receiving cradle includes an apex;

the second object receiving cradle includes apex; and the apex of the first object receiving cradle and the apex of the second side object receiving cradle are separated by a distance generally equal to the thickness of the elongated member.

2. The support structure of claim 1 wherein the first and second ribs of the second set of ribs are axially spaced from corresponding edges of the elongated member along the second axis.

3. The support structure of claim 1 wherein the first and second ribs of the first set of ribs and the first and second ribs of the second set of ribs have a predetermined height and wherein the first and second ribs projecting from the second side of the elongated member have a predetermined height.

4. The support structure of claim 3 wherein the predetermined height of the first and second ribs of the first set of ribs and of the first and second ribs of the second set of ribs is generally equal to the predetermined height of the first and second ribs projecting from the second side of the elongated member.

5. The support structure of claim 1 further comprising a third set of ribs projecting from the first side of the elongated member at a location axially spaced from the second set of ribs so as to define a second object receiving cradle therebetween, the third set of ribs including first and second ribs axially spaced from each other along a third axis transverse to the longitudinal axis of the elongated member.

6. A support structure for supporting an object, comprising:

an elongated member extending along a longitudinal axis and having first and second sides, first and second edges, first and second ends, and a thickness, the first side of the elongated member including:

a first plurality of ribs projecting therefrom and being spaced between the first and second ends along a first axis, each of the first plurality of ribs being laterally spaced from the first edge;

a second plurality of ribs projecting therefrom and being spaced between the first and second ends along a second axis, each of the second plurality of ribs being laterally spaced from the second edge; and a plurality of depressions formed therein and being spaced between the first and second ends along a third axis disposed between the first and second axis, each of the plurality of depressions being between one of the first plurality of ribs and one of the second plurality of ribs and forming a corresponding rib projecting from the second side of the elongated member, the ribs projecting from the second side of the elongated member being spaced between the first and second ends along the third axis;

wherein:

the ribs projecting from the second side of the elongated member includes a first rib and a second rib, the first rib and the second rib defining a second side object receiving cradle therebetween;

the first plurality of ribs projecting from the first side of the elongated member includes a first rib and a second rib, the first rib and the second rib partially defining a first object receiving cradle therebetween;

the first object receiving cradle opens in a first direction and the second side object receiving cradle opens in a second direction opposite to the first direction;

the first object receiving cradle includes an apex;

the second object receiving cradle includes an apex; and the apex of the first object receiving cradle on the first side of the elongated member and the apex of the second side object receiving cradle are separated by a distance generally equal to the thickness of the elongated member.

7. The support structure of claim 6 wherein each of the first plurality of ribs is aligned with a corresponding rib of the second plurality of ribs along a corresponding axis transverse to the longitudinal axis of the elongated member.

8. The support structure of claim 6 wherein the second plurality of ribs projecting from the first side of the elongated member includes a first rib and a second rib, the first rib and the second rib of the second plurality of ribs partially defining the first object receiving cradle therebetween.

* * * * *